US011670837B2

(12) United States Patent
Wu et al.

(10) Patent No.: US 11,670,837 B2
(45) Date of Patent: Jun. 6, 2023

(54) ANTENNA AND TERMINAL

(71) Applicant: Lenovo (Beijing) Co., Ltd., Beijing (CN)

(72) Inventors: Shuangjie Wu, Beijing (CN); Jian Ren, Beijing (CN); Wei Wang, Beijing (CN); Zhiyuan Duan, Beijing (CN)

(73) Assignee: LENOVO (BEIJING) CO., LTD., Beijing (CN)

( * ) Notice: Subject to any disclaimer, the term of this patent is extended or adjusted under 35 U.S.C. 154(b) by 271 days.

(21) Appl. No.: 16/584,650

(22) Filed: Sep. 26, 2019

(65) Prior Publication Data

US 2020/0106166 A1 Apr. 2, 2020

(30) Foreign Application Priority Data

Sep. 30, 2018 (CN) ..... 201811163488.4

(51) Int. Cl.

| | |
|---|---|
| ***H01Q 1/24*** | (2006.01) |
| ***H01Q 1/36*** | (2006.01) |
| ***H01Q 1/52*** | (2006.01) |
| ***H01Q 21/30*** | (2006.01) |

(52) U.S. Cl.

CPC ..... *H01Q 1/243* (2013.01); *H01Q 1/36* (2013.01); *H01Q 1/526* (2013.01); *H01Q 21/30* (2013.01)

(58) Field of Classification Search

CPC ..... H01Q 1/243; H01Q 1/52; H01Q 21/30; H01Q 1/22–24; H01Q 21/065

See application file for complete search history.

(56) References Cited

U.S. PATENT DOCUMENTS

| | | | | |
|---|---|---|---|---|
| 9,484,631 | B1 * | 11/2016 | Napoles | H01Q 5/378 |
| 10,454,156 | B1 * | 10/2019 | Yang | H01Q 1/48 |
| 2004/0137950 | A1 * | 7/2004 | Bolin | H01Q 5/40 455/562.1 |
| 2018/0034134 | A1 * | 2/2018 | Dalmia | H01Q 1/243 |
| 2019/0020100 | A1 * | 1/2019 | Jong | H01Q 1/48 |
| 2019/0229413 | A1 * | 7/2019 | Jong | H01Q 1/38 |
| 2019/0319367 | A1 * | 10/2019 | Edwards | H01Q 3/2605 |
| 2019/0379124 | A1 * | 12/2019 | Zou | H01Q 1/48 |
| 2020/0036083 | A1 * | 1/2020 | Kim | H01Q 1/2283 |
| 2020/0169007 | A1 * | 5/2020 | Song | H01Q 21/293 |

FOREIGN PATENT DOCUMENTS

| | | | |
|---|---|---|---|
| CN | 108321498 | A | 7/2018 |
| CN | 108400450 | A | 8/2018 |
| CN | 108511890 | A | 9/2018 |

* cited by examiner

*Primary Examiner* — Hasan Islam

(74) *Attorney, Agent, or Firm* — Anova Law Group, PLLC

(57) ABSTRACT

An antenna includes a first portion and a second portion. The first portion is of a first shape and the second portion is of a second shape. The second portion is connected to the first portion by a junction. The antenna operates in a first frequency band and a second frequency band.

11 Claims, 3 Drawing Sheets

ANTENNA AND TERMINAL

CROSS-REFERENCE TO RELATED APPLICATION

This application claims the priority to Chinese Patent Application No. 201811163488.4, entitled "Antenna and Terminal," filed on Sep. 30, 2018, the entire content of which is incorporated herein by reference.

TECHNICAL FIELD

The present disclosure relates to the field of antennas and in particular relates to an antenna and a terminal.

BACKGROUND

The fifth generation mobile communication technology standards (5G NR) allocate two frequency bands for wireless frequencies, a frequency range 1 ("FR1") (sub-6 GHz spectrum) and a frequency range 2 ("FR2") (millimeter wave (hereinafter, "mmWave") spectrum), where an antenna operating in the sub-6 GHz spectrum can be combined with a 4G/3G/2G antenna, and independent antenna array is mainly adopted as mmWave antenna. Accordingly, for current 5G terminals, one of the major challenges is to support the co-design of two frequency band antennas on a high-integration terminal with limited space.

Existing antenna designs mostly support a wider bandwidth by coupling the sub-6G antenna module to the mmWave antenna module. However, this coupled antenna design requires high dimensional accuracy of the antennas, which increases the difficulty of achieving product consistency.

SUMMARY

In one aspect of the present disclosure, an antenna is provided. The antenna includes: a first portion, the first portion being of a first shape; and a second portion, the second portion being of a second shape, connected to the first portion by a junction. The antenna operates in a first frequency band and a second frequency band.

In another aspect of the present disclosure, a sub-6G antenna is combined with a 4G/3G/2G antenna. The first portion of the antenna is a sub-6G/4G/3G/2G antenna.

In some embodiments, the second portion of the antenna is a substrate board for an mmWave antenna.

In some embodiments, the first shape of the first portion is a strip shape or a plate shape.

In some embodiments, the second shape of the second portion is a strip shape or a plate shape.

In some embodiments, the first portion and the second portion are made from metal material.

In some embodiments, the antenna further includes an antenna array. The antenna array is arranged on the second portion of the antenna. The antenna array operates in a second frequency band, and a frequency of the second frequency band is higher than a frequency of the first frequency band.

According to another aspect of the present disclosure, the first frequency band of the antenna is a sub-6G or 4G/3G/2G frequency band and the second frequency band of the antenna is an mmWave frequency band.

In some embodiments, the antenna array is located on a front side or a back side of the second portion.

In some embodiments, a feed point of the antenna is located at the junction between the first portion and the second portion of the antenna. The feed point is on a first side of the second portion. A ground point of the antenna is located on the second side of the second portion of the antenna, which is opposite to the first side of the second portion of the antenna.

In some embodiments, the antenna further includes a processing chip, corresponding to the antenna array. The processing chip is disposed on the second portion of the antenna. The processing chip processes a signal received by the antenna array or a signal transmitted by the antenna array.

In some embodiments, the antenna further includes a shielding member. The shielding member is disposed on the second portion of the antenna for shielding the processing chip.

Another aspect of the present disclosure provides a terminal. The terminal includes an antenna. The antenna includes: a first portion, the first portion being of a first shape; and a second portion, the second portion being of a second shape. The second portion is connected to the first portion by a junction. The antenna transmits signals to and from the terminal in a first frequency band and a second frequency band.

In some embodiments with respect to the terminal, a sub-6G antenna is combined with a 4G/3G/2G antenna. The first portion of the antenna is a sub-6G/4G/3G/2G antenna.

In some embodiments with respect to the terminal, the second portion of the antenna is an mmWave antenna.

In some embodiments with respect to the terminal, a feed point of the antenna is located at the junction between the first portion and the second portion. The feed point is on a first side of the second portion of the antenna. A ground point of the antenna is located on a second side of the second portion, which is opposite to the first side of the second portion.

In some embodiments with respect to the terminal, the antenna further includes an antenna array. The antenna array is arranged on the second portion of the antenna. The antenna array operates in a second frequency band, and a frequency of the second frequency band is higher than a frequency of the first frequency band.

In some embodiments with respect to the terminal, the first frequency band of the antenna is a sub-6G or 4G/3G/2G frequency band, and the second frequency band of the antenna is an mmWave frequency band.

According to another aspect of the present disclosure, a method for transmitting 4G/3G/2G signals and mmWave signals with an integrated antenna is provided. The method includes: receiving, by a first portion of the integrated antenna, a first signal occupied in a first frequency band; receiving, by a second portion of the integrated antenna, a second signal occupied in a second frequency band; transmitting, by the first portion of the integrated antenna, the first signal to a first receiver; and transmitting, by the second portion of the integrated antenna, the second signal to a second receiver. A 4G/3G/2G signal has a frequency of the first frequency band, and an mmWave signal has a frequency of the second frequency band. A frequency of the second frequency band is higher than a frequency of the first frequency band.

In some embodiments, with respect to the method for transmitting 4G/3G/2G signals and mmWave signals with an integrated antenna, the first frequency band is a sub-6G/4G/3G/2G frequency band.

The above aspects will be described in detail with accompanying drawings.

BRIEF DESCRIPTION OF THE DRAWINGS

In order to more clearly illustrate the technical solutions provided by the present disclosure, the drawings used in the description of the embodiments will be briefly described below.

DETAILED DESCRIPTION OF THE EMBODIMENTS

The detailed description of the present disclosure and the technical content of the present disclosure will be described in detail with reference to the accompanying drawings. The described embodiments are only part of the embodiments of the present disclosure. Other embodiments acquired by a person of ordinary skill in the art based on the described embodiments without departing from the spirit of the disclosure are the within scope of the present disclosure.

The present disclosure provides a design with an mmWave antenna and a sub-6G/4G/3G/2G antenna on a terminal. An antenna array may be adopted as an mmWave antenna. Specifically, since an mmWave antenna array may require a substrate board to assist radiation, the entire antenna array of the mmWave antenna may be effectively grounded or closed and may directly reuse the space of the sub-6G/4G/3G/2G antenna, to make the mmWave antenna array substrate board a part of the sub-6G/4G/3G/2G antenna. This may facilitate the use of previous frequency band for each antenna to support the difference, which effectively achieve antenna spatial reuse design.

Compared with the existing designs with the coupled modules, the present disclosure provides another type of antenna design, so that the antenna can be more efficiently utilized in a limited terminal space. This may effectively avoid the issues of controlling product consistency resulting from the coupling design and may increase the structural strength of the terminal design.

The technical solutions of the present disclosure are further described below in conjunction with the accompanying drawings and specific embodiments.

Embodiment One

Figure 1:
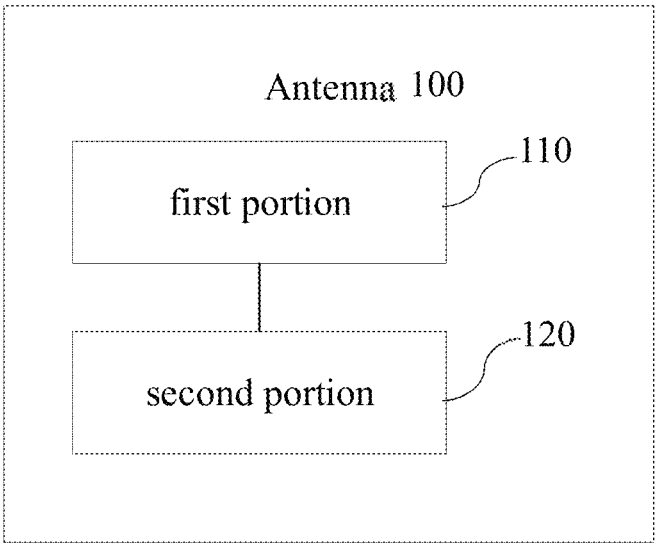
FIG. 1 is a first schematic structural diagram of an antenna according to certain embodiments of the present disclosure.

As shown in FIG. 1, an antenna 100 is provided in this embodiment. The antenna 100 may include a first portion 110 and a second portion 120. The first portion 110 may be of a first shape and the second portion 120 may be of a second shape. The antenna 100 may operate in a first frequency band, to implement a function of a sub-6G/4G/3G/2G antenna.

Here, the first frequency band can be a low frequency band, and the first frequency band may be used to satisfy an operating frequency band of the sub-6G/4G/3G/2G antenna.

In some embodiments, the first shape may be different from the second shape. For example, the first shape may be a strip shape, and the second shape may be a plate shape.

In some embodiments, the first shape and the second shape may be the same. For example, the first shape may be a strip shape, and the second shape may also be a strip shape; or, the first shape may be a plate shape, and the second shape may also be a plate shape.

In some embodiments, the first portion 110 of the antenna 100 and the second portion 120 of the antenna 100 may be made from a metal material.

In this embodiment, the second portion 120 of the antenna 100 may be a mmWave antenna substrate board. As mentioned, the mmWave antenna substrate board may be designed to be a metal material, and such metal design may facilitate any direct expansion of the antenna design on this basis.

The antenna 100 of this embodiment may include: a first portion 110, the first portion being of a first shape; a second portion 120, the second portion being of a second shape. The antenna 100 can operate in a first frequency band, to implement a function of a sub6G/4G/3G/2G antenna.

Embodiment Two

Figure 2:
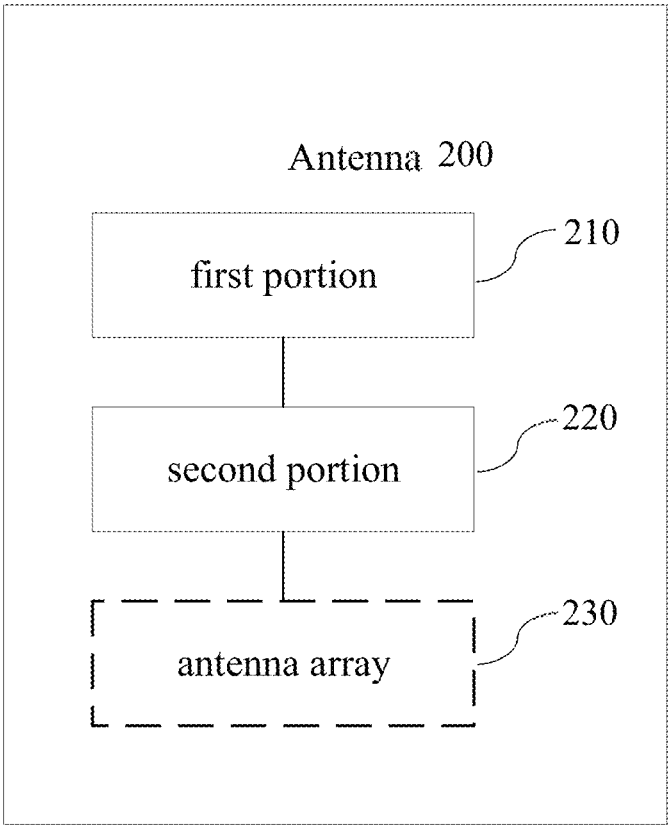
FIG. 2 is a second schematic structural diagram of an antenna according to certain embodiments of the present disclosure.

As shown in FIG. 2, according to the present disclosure, an antenna 200 is provided. The antenna 200 may include a first portion 210, a second portion 220, and an antenna array 230 arranged on the second portion 220. The first portion 210 may be of a first shape and the second 220 portion may be of a second shape. The antenna may operate in a first frequency band, to implement a function of a sub-6G/4G/3G/2G antenna; and the antenna array may operate in a second frequency band. A frequency of the second frequency band is higher than a frequency of the first frequency band.

Here, the second portion 220 of the antenna 200 may be used by the first portion 210 of the antenna 200. Specifically, the first portion 210 and the second portion 220 may be connected by a preset connection manner, e.g., a preset junction. The preset junction may be a hard/solid connection. Accordingly, based on the second portion 220 of the antenna 200, the first portion 210 may be constructed by extending or widening the length of the second portion 220.

In some embodiments, the second portion 220 of the antenna 200 may be the substrate board of an mmWave.

In some embodiments of the present disclosure, the first frequency band can be a low frequency band, and the first frequency band may be used to satisfy an operating frequency band of a sub-6G/4G/3G/2G antenna. The second frequency band can be a high frequency band, and the second frequency band may be used to satisfy an operating frequency band of the mmWave antenna.

In some embodiments, the first shape and the second shape may be the same. For example, the first shape may be a strip shape, and the second shape may also be a strip shape; or, the first shape may be a plate shape, and the second shape may also be a plate shape.

In some embodiments, the first shape may be different from the second shape. In one example, the first shape may be a strip shape and the second shape may be a plate shape.

In some embodiments consistent with the present disclosure, the first portion 210 of the antenna 200 and the second portion 220 of the antenna 200 may be made from a metal material.

The antenna 200 of this embodiment may include: a first portion, the first portion being of a first shape; and a second portion, the second portion being of a second shape. The antenna 200 can operate in a first frequency band, to implement a function of a sub6G/4G/3G/2G antenna. An antenna array 230 may be arranged on the second portion 220 of the antenna 200, and the antenna array 230 can operate in a second frequency band. Therefore, the antenna 20 can work in both the first frequency band and the second frequency band. Accordingly, this antenna design is simple and practical, which can reduce the difficulty of achieving antenna product consistency.

Embodiment Three

Figure 3:
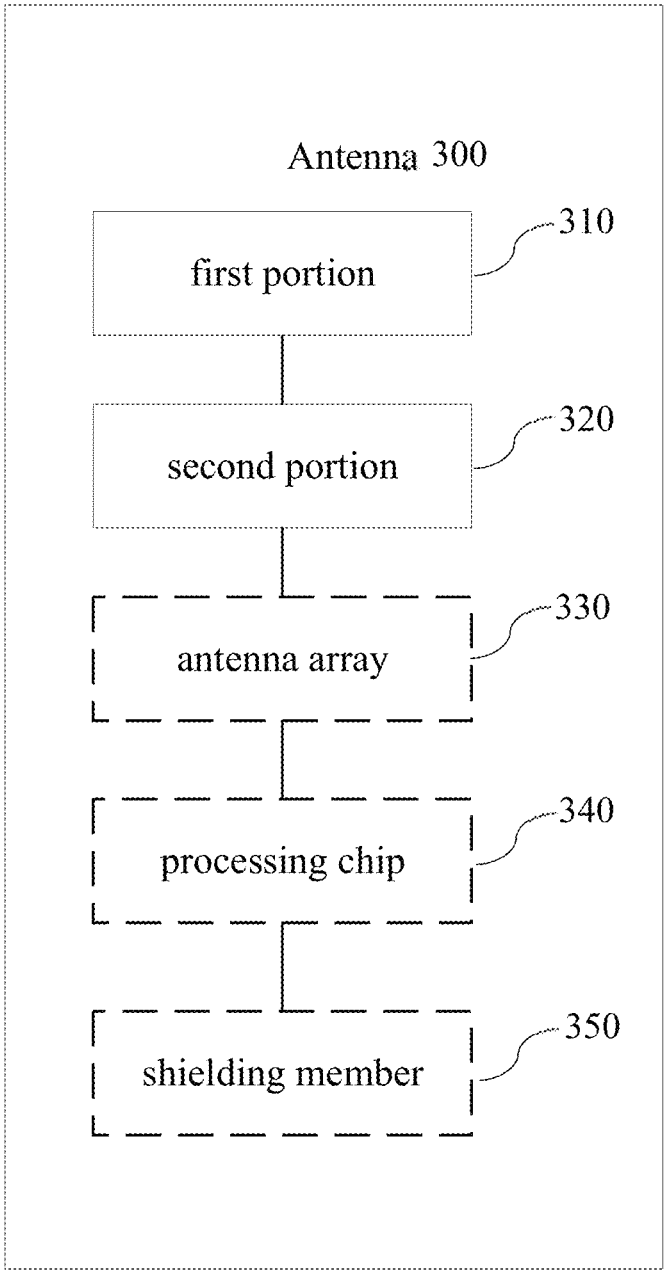
FIG. 3 is a third schematic structural diagram of an antenna according to certain embodiments of the present disclosure.

As shown in FIG. 3, in this embodiment, an antenna 300 is provided. The antenna 300 may include a first portion 310 of the antenna 300, a second portion 320 of the antenna 300, an antenna array 330 arranged on the second portion 320 of the antenna 300, and a processing chip 340 corresponding to the antenna array 330. The first portion 310 may be of a first shape and the second portion 320 may be of a second shape. The processing chip 340 may be disposed on the second portion 320 of the antenna 300 and can be used to process a signal received by the antenna array 330 or a signal transmitted by the antenna array 330.

According to another aspect of the present disclosure, the antenna 300 may operate in a first frequency band, to implement a function of a sub-6G/4G/3G/2G antenna.

According to another aspect of the present disclosure, the antenna array 330 may operate in a second frequency band.

Here, the first frequency band can be a low frequency band, and the first frequency band may be used to satisfy an operating frequency band of a sub-6G/4G/3G/2G antenna. The second frequency band can as a high frequency band, and the second frequency band may be used to satisfy an operating frequency band of an mmWave antenna. A frequency of the second frequency band may be higher than a frequency of the first frequency band.

According to certain embodiments, the antenna array 330 may be located on the front or back side of the second portion 320 of the antenna 300.

This embodiment of the present disclosure does not limit the arrangement manner of the antenna array 330 on the second portion 320 of the antenna 300, and the antenna array 330 can be arbitrarily arranged on the second portion 320 of the antenna 300. For example, the antenna array 330 may be arranged on the second portion 320 of the antenna 300 in a direction parallel or perpendicular to the second portion 320 of the antenna 300.

Because the antenna array 330 may integrate the transmitter-receiver systems of the processing chip 340 (e.g., an mmWave chip), which may be the main factor affecting its reuse/sharing of the low frequency antenna, the skin effect of the high frequency signal and effective shielding are considered for this part of the design.

In some embodiments, the antenna 300 may further include a shielding member 350, which may be disposed on the second portion 320 of the antenna 300 for shielding the processing chip 340.

According to another aspect of the present disclosure, the shielding member 350 may be made from a metal material. The shielding member 350 can effectively shield mutual interference among signals.

In some embodiments of the present disclosure, the shielding member 350 may have a cavity structure to prevent electromagnetic waves from passing through.

The antenna 300 of this embodiment may include: a first portion 310, the first portion being of a first shape; and a second portion 320, the second portion being of a second shape. The antenna 300 can operate in a first frequency, to implement a function of a sub6G/4G/3G/2G antenna. An antenna array 330 may be arranged on the second portion 320 of the antenna 300, and the antenna array 300 can work in a second frequency band. Therefore, the antenna 300 can operate in both the first frequency band and the second frequency band. Accordingly, such an antenna design is simple and practical, which can reduce the difficulty in achieving antenna product consistency. The antenna 300 may further include a shielding member 350, which may effectively shield mutual interferences among signals.

Embodiment Four

In this embodiment, an antenna is provided. The antenna may include a first portion, a second portion, and an antenna array arranged on the second portion. The first portion of the antenna may be of a first shape and the second portion of the antenna may be of a second shape. The antenna may operate in a first frequency band and the antenna array may operate in a second frequency band. A frequency of the second frequency band may be higher than a frequency of the first frequency band.

Here, the second portion of the antenna is also used/shared by the first portion of the antenna and the antenna array.

In some embodiments, the first portion of the antenna and the second portion of the antenna may be made from a metal material. For example, the second portion of the antenna may be a substrate board for an mmWave antenna. Since the substrate board for the mmWave antenna may be designed to be metal, the second portion of the antenna can be directly expanded on the substrate board.

In some embodiments, a feed point of the antenna is located at a junction between the first portion of the antenna and the second portion of the antenna. The feed point may be on a first side of the second portion of the antenna. A ground point of the antenna may be located on a second side of the second portion of the antenna, opposite to the first side having the feed point.

It should be noted that the feed point is not necessarily located at the junction between the first portion of the antenna and the second portion of the antenna. The position of the feed point can be determined by design requirements, since different frequency band requirements correspond to different feed point positions and different environmental requirements correspond to different feed point positions.

Additionally, the ground point is not necessarily located on the second portion of the antenna. For example, the ground point may be located on the first portion of the antenna. The ground point has two functions: one is to ground the antenna array, and the other is to be part of the sub-6G/4G/3G/2G antenna.

The antenna of this embodiment may further include: a feed point located at the junction between the first portion and the second portion, the feed point being on a first side of the second portion; and a ground point located at a second side of the second portion of the antenna, opposite to the first side of the second portion. In this embodiment, the antenna may operate in both the first frequency band and the second frequency band. Such design is simple and practical, which can reduce the difficulty of achieving consistency for inverted-F antenna ("IFA") products.

Based on the above embodiments of the present disclosure, a design for integrating an mmWave antenna and a sub6G/4G/3G/2G antenna on a terminal is provided. Specifically, since the antenna array requires a substrate board to assist radiation, the entire antenna array of the mmWave antenna may be effectively grounded or closed and may directly reuse the space of the sub-6G/4G/3G/2G antenna, to make the mmWave antenna array substrate board a part of the sub-6G/4G/3G/2G antenna. This may facilitate the use of the previous frequency band for each antenna to support the difference, which effectively achieve antenna spatial reuse design.

Figure 4:
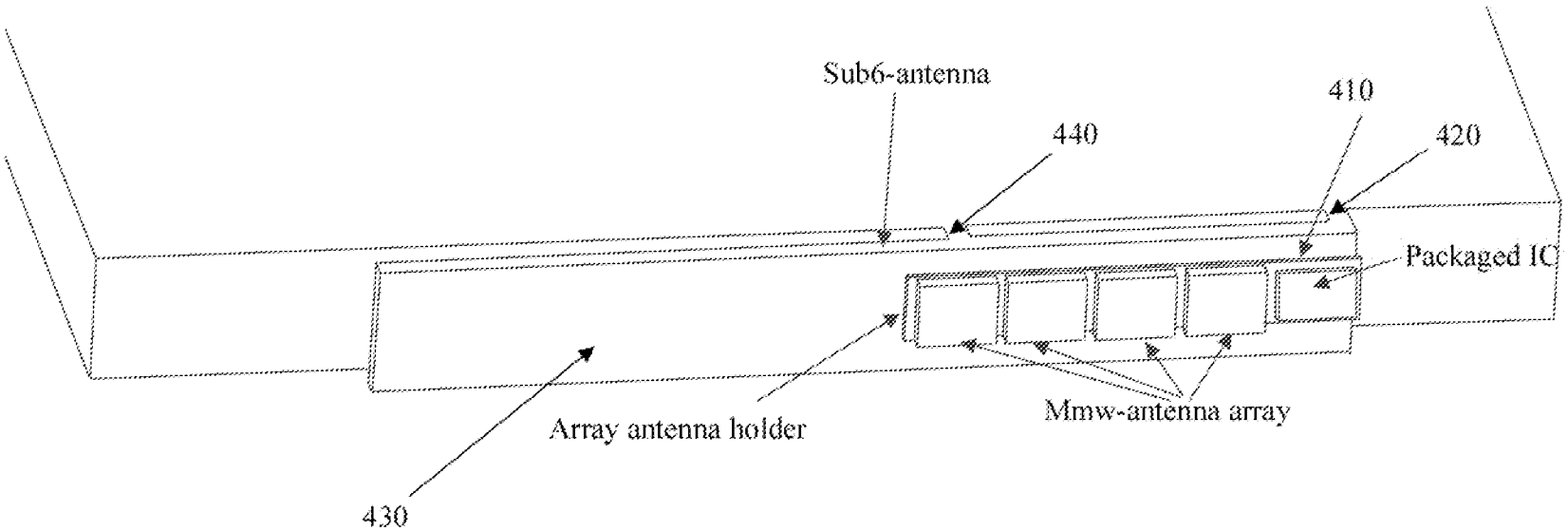
FIG. 4 is a schematic diagram of a design implementation of an IFA antenna according to certain embodiments of the present disclosure.

As shown in FIG. 4, a mmWave module 410 may be used as a part of a sub-6G/4G/3G/2G antenna. At the same time, the substrate board for the mmWave antenna may be grounded at a ground point 420. Afterward, the antenna may be added other auxiliary parts 430, and by determining the effective feed point position 440 the antenna can achieve a function of the sub-6G antenna. The mmWave module in FIG. 4 should be grounded, but there is no limitation imposed on its position. Meanwhile, other parts of the antenna can be designed according to the antenna design requirements, without limitation to the current position and shape.

It should be noted that FIG. 4 is only one of the implementation schemes, in which a representative IFA antenna may be formed, in order to achieve the antenna design requirements for 5 GHz, or 3 GHz or less.

Embodiment Five

In this embodiment, a terminal is provided. The terminal may include an antenna. The antenna may include a first portion of the antenna and a second portion of the antenna. The first portion may be of a first shape and the second portion may be of a second shape. The antenna may operate in a first frequency band, to implement a function of a sub-6G/4G/3G/2G antenna.

According to certain embodiments of the present disclosure, the antenna may further include an antenna array, which is arranged on the second portion of the antenna. The antenna array may operate in a second frequency band, to implement a function of an mmWave antenna. A frequency of the second frequency band is higher than a frequency of the first frequency band.

In certain embodiments, the antenna may further include a processing chip corresponding to the antenna array. The processing chip may be disposed on the second portion of the antenna and may be used to process a signal received by the antenna array or a signal transmitted by the antenna array.

In some embodiments, the antenna may further include a shielding member which may be disposed, or fixed, on the second portion of the antenna for shielding the processing chip.

According to certain embodiments of the present disclosure, a feed point of the antenna is located at a junction between the first portion of the antenna and the second portion of the antenna. Furthermore, the feed point is on a first side of the second portion of the antenna. A ground point of the antenna is located on a second side of the second portion of the antenna, opposite to the first side having the feed point.

In this embodiment, the terminal may include, but not limited to, a mobile phone, a tablet computer, a laptop computer, a television, etc.

The terminal in this embodiment can support at least two frequency bands: the first frequency band and the second frequency band.

The antenna provided by this embodiment can support the standard for the fifth-generation mobile communication (or the fifth-generation mobile communication network. 5G). That is, the antenna can allocate an FR1 (a sub-6 GHz spectrum) wireless frequency band. Meanwhile, the antenna may further utilize a metal substrate board for an antenna array, which can support an FR2 (an mmWave spectrum) frequency band, and accordingly, integrate the antenna with the antenna array. The metal substrate board may be a part of an antenna radiator. Therefore, the space occupied by the antenna in electronic devices can be reduced. Further, the antenna may be a part of the metal for the metal frame, where the radiator is located on the electronic device.

In the foregoing described embodiments provided by the present disclosure, it should be understood that the disclosed apparatus and method may be implemented in other manners. The device embodiments described above are merely illustrative. For example, the division of a unit may only be a division of logical functions; there may be other manners of division in actual implementations. For example, multiple units or components may be combined, or may be integrated into another system; or, some features of the units or components may be ignored or unexecuted. In addition, the coupling or direct coupling, or communication connection among the components shown or discussed may be indirect coupling or communication connection through certain interfaces, devices or units, and may be electrical, mechanical or other forms thereof.

The units described above as separate components may or may not be physically separated, and the components displayed as units may or may not be physical units; that is, these components may be located at one place, or may be distributed to multiple network units. Some, or all, of the units may be selected according to actual needs to achieve the purpose of the current embodiment.

In addition, each functional unit of the present disclosure may be integrated into one processing unit, or may be separately used as a single unit; two or more units may also be integrated into one unit. The above-mentioned integrated units can be implemented in the form of hardware or hardware plus software functional units.

A person skilled in the art can understand that all or part of the steps in the above described embodiments may be completed by a hardware related to program instructions. The foregoing program may be stored in a computer readable storage medium, and the program may execute the steps in the foregoing described embodiments in program execution. The foregoing storage medium may include a mobile storage device, a read-only memory ("ROM"), a random-access memory ("RAM"), a magnetic disk, an optical disk, or any medium that can store program code.

Alternatively, the above-described integrated unit of the present disclosure may be stored in a computer readable storage medium, if it is implemented in the form of a software functional module and sold or used as a stand-alone product. Based on such understanding, the technical solutions of the present disclosure may be embodied in the form of a software product. Such software product may be stored in a storage medium, including causing a computer equipment (e.g., a personal computer, a server, a network device, etc.) by a plurality of instructions, to perform all or part of the methods described in various embodiments of the present disclosure. The foregoing described storage medium may include a mobile storage device, an ROM, a RAM, a magnetic disk, an optical disk, or any medium that can store program code.

The foregoing described embodiments are only specific embodiments of the present disclosure. The scope of the present disclosure should not be limited to the above embodiments. It will be appreciated by those skilled in the art that variations, and/or substitutions, and/or combinations of the various embodiments of the present disclosure can be made without departing from the scope of the present disclosure. Therefore, the scope of the invention should be determined by the scope of the appended claims or the equivalents of the appended claims.

What is claimed is:

1. An integrated antenna, comprising:

a first portion having a first shape;

a second portion having a second shape different from the first shape, wherein the first portion and the second portion form a first radiator of a first antenna operating in a first frequency band; and an antenna array arranged parallel on the second portion, the second portion being a metal substrate board of the antenna array, wherein the antenna array and the second portion form a second radiator of a second antenna operating in a second frequency band having a higher frequency range than the first frequency band, and the first radiator shares the second portion with the second radiator;

wherein the first frequency band of the integrated antenna is a sub-6G or 4G/3G/2G frequency band and the second frequency band of the integrated antenna is a mmWave frequency band.

2. The integrated antenna according to claim 1, wherein the first shape is a strip shape or a plate shape.

3. The integrated antenna according to claim 1, wherein the second shape is a strip shape or a plate shape.

4. The integrated antenna according to claim 1, wherein the first portion and the second portion are made from metal material.

5. The integrated antenna according to claim 1, wherein the antenna array is located on a front side or a back side of the second portion.

6. The integrated antenna according to claim 1, wherein the first antenna includes:

a feed point located on a first side of the second portion; and a ground point located on a second side of the second portion, opposite to the first side of the second portion.

7. The integrated antenna according to claim 1, further comprising a processing chip corresponding to the antenna array, the processing chip being disposed on the second portion, wherein the processing chip processes a signal received by the antenna array or a signal transmitted by the antenna array.

8. The integrated antenna according to claim 7, further comprising a shielding member, the shielding member being disposed on the second portion for shielding the processing chip.

9. A terminal, comprising:

an integrated antenna, including:

a first portion having a first shape;

a second portion having a second shape different from the first shape, wherein the first portion and the second portion form a first radiator of a first antenna operating in a first frequency band; and an antenna array arranged parallel on the second portion, the second portion being a metal substrate board of the antenna array, wherein the antenna array and the second portion form a second radiator of a second antenna operating in a second frequency band having a higher frequency range than the first frequency band, and the first radiator shares the second portion with the radiator;

wherein the first frequency band of the integrated antenna is a sub-6G or 4G/3G/2G frequency band and the second frequency band of the integrated antenna is a mmWave frequency band.

10. The terminal according to claim 9, wherein the first antenna includes:

a feed point on a first side of the second portion; and a ground point of the integrated antenna located on a second side of the second portion, opposite to the first side of the second portion.

11. A method for transmitting sub-6G signals and mmWave signals using an integrated antenna, the method comprising:

receiving and transmitting, by a first portion and a second portion of the integrated antenna, signals in a first frequency band, wherein the first portion and the second portion of the integrated antenna forms a first radiator of a first antenna operating in the first frequency band, the first portion has a first shape, the second portion has a second shape different from the first shape;

receiving and transmitting, by an antenna array and the second portion, signals in a second frequency band, wherein the antenna array is arranged parallel on the second portion, the second portion is a metal substrate board of the antenna array, the antenna array and the second portion form a second radiator of a second antenna operating in the second frequency band having a higher frequency range than the first frequency band, and the first radiator shares the second portion with the second radiator;

wherein the first frequency band of the integrated antenna is a sub-6G or 4G/3G/2G frequency band and the second frequency band of the integrated antenna is a mmWave frequency band.

* * * * *